United States Patent [19]

Wasmer et al.

[11] 4,380,217

[45] Apr. 19, 1983

[54] BREAKER POINT SYSTEM

[75] Inventors: Anthony E. Wasmer; Stephen L. Koenigs, both of New Holstein, Wis.

[73] Assignee: Tecumseh Products Company, Tecumseh, Mich.

[21] Appl. No.: 264,976

[22] Filed: May 18, 1981

[51] Int. Cl.[3] ..... F02P 17/00; F02P 1/00

[52] U.S. Cl. ..... 123/146.5 A; 200/19 DR

[58] Field of Search ..... 123/146.5 A; 200/19, 200/31, 19 DR, 306, 19 A, 21, 24

[56] References Cited

U.S. PATENT DOCUMENTS

| | | | |
|---|---|---|---|
| 1,048,832 | 12/1912 | Heins | 123/146.5 A |
| 1,074,984 | 10/1913 | Scheibe | 200/19 A |
| 1,144,135 | 6/1915 | Kaisling | 123/146.5 A |
| 1,219,680 | 3/1917 | Taylor | 123/146.5 A |
| 1,267,671 | 5/1918 | Lang | 123/146.5 A |
| 2,912,530 | 10/1957 | Franchon | 200/31 |
| 3,581,025 | 5/1971 | Yeo et al. | 200/19 |
| 4,005,294 | 1/1977 | Brayley et al. | 200/19 |
| 4,064,858 | 12/1977 | Forde | 123/146.5 A |
| 4,072,891 | 2/1978 | Campbell | 123/146.5 A |

*Primary Examiner*—Raymond A. Nelli

*Attorney, Agent, or Firm*—Albert L. Jeffers; Roger M. Rickert

[57] ABSTRACT

An ignition system breaker point assembly for an internal combustion engine to be mounted on the engine adjacent a rotating engine shaft is disclosed and includes an electrically insulating cam supported on the engine shaft for rotation therewith and an electrically insulating housing containing a movable contact member and a stationary contact member with a portion of the movable member extending from the housing toward the cam surface to be actuated by the cam for making and breaking electrical contact. The stationary contact may be adjusted from outside the housing for varying the breaker point gap and a spring may be included within the housing providing continuous electrical and mechanical contact with the movable contact member, urging that movable contact member toward the stationary contact member and the portion of the movable contact member which extends beyond the housing toward the cam. Desirably, the cam comprises an eccentric annulus of a self-lubricating electrically insulating material.

25 Claims, 6 Drawing Figures

BREAKER POINT SYSTEM

BACKGROUND OF THE INVENTION

The present invention relates generally to contacts which periodically make and break an electrical circuit and more particularly to such contacts for use in an internal combustion engine ignition system.

Breaker or contact points are well known in both magnetos and the conventional battery operated type ignition systems and typically include a member which follows a rotating cam to open and close the contacts thereby periodically interrupting ignition coil primary winding current flow inducing a high voltage ignition spark producing current surge in a secondary ignition coil winding.

One problem with such contact systems is that if the contacting surfaces are not kept clean, the conductivity and therefore also ignition operation, are adversely effected. It is frequently difficult to prevent contact contamination, especially since such breaker point systems are frequently located closely adjacent to and actuated by a crank or cam shaft extending from the engine crankcase, and oil leakage about that shaft tends to foul the contact surfaces. Another problem associated with such breaker point systems is that the cam follower which is typically an insulating member fastened to a movable breaker point arm and riding on the cam surface wears, requiring periodic readjustmentof point gap. Such readjustments of the point gap frequently require partial dissembly of the ignition system to gain access to the adjustable member, resulting in undesirable time and expense of maintenance. This undesirable aspect may also be present during initial assembly of the system.

SUMMARY OF THE INVENTION

Among the several objects of the present invention may be noted the minimization of the foregoing adversities; the reduction of contact contamination in an ignition breaker point system; the reduction in the cost and complexity of an ignition breaker point system; the accomplishment of the previous object by reducing the number of components and assembly line costs associated with the ignition contact points; the provision of contact points which are enclosed yet are externally adjustable for point gap; the provision of a self-lubricating breaker point system; and the elimination of the need for a separate cam follower in a breaker point system. These as well as other objects and advantageous features of the present invention will be in part apparent and in part pointed out hereinafter.

In general, the ignition system breaker point assembly includes an electrically insulating eccentric annulus to be mounted on and rotated with an engine shaft along with an electrically conductive lever arm forming a movable electric contact engageable with the annulus and pivotable about an electrically insulating fulcrum with a spring urging the lever arm in a pivotal manner about the fulcrum toward the annulus. The breaker point assembly includes an adjustable stationary electrical contact located adjacent the lever arm and spaced therefrom during a portion only of each complete revolution of the annulus with this spacing being less than twice the eccentricity of the annulus so as to make and break electrical contact between the lever arm and stationary contact during each annulus revolution. The annulus is preferably formed of a self-lubricating material and provides a continuous electrically insulating barrier between the lever arm and the stationary contact.

Also in general and in one form of the invention, a contact point assembly includes an electrically insulating housing having a fulcrum therein and a lever arm engaging the fulcrum with an electrical contact near one end thereof and with the other end thereof extending beyond the housing to engage a rotating cam member. A threaded member passes into the housing and comprises an adjustable stationary contact. A spring within the housing urges the lever arm into engagement with the fulcrum as well as urging the lever arm contact toward the stationary contact and the lever arm other end into engagement with the cam member. Electrical connection between the lever arm contact and an igniton coil includes the spring.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
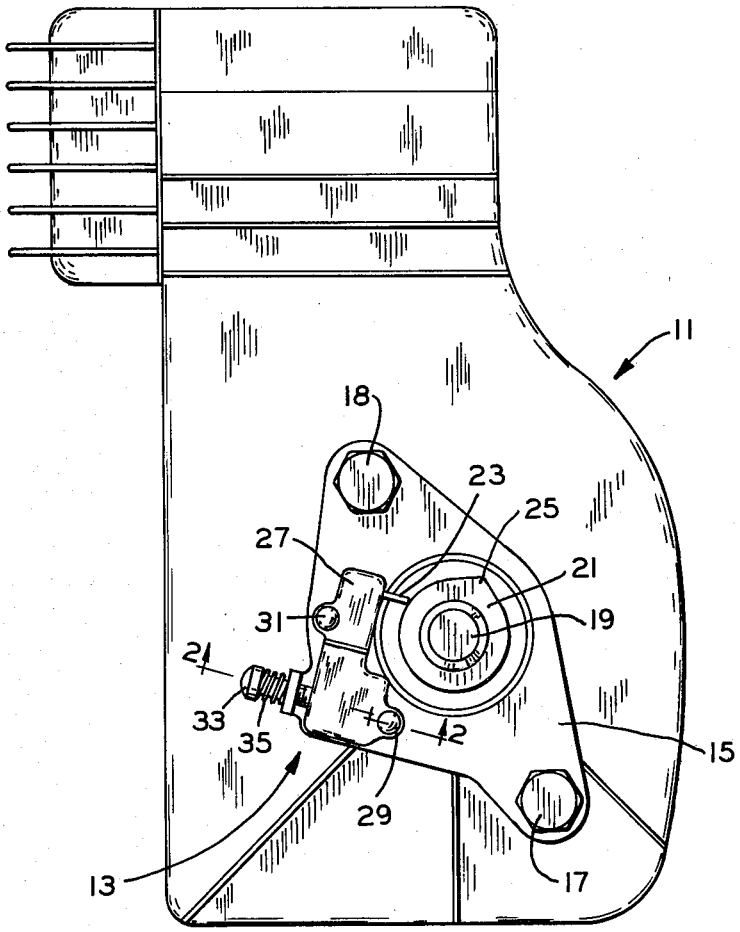
FIG. 1 is a side elevation view of an internal combustion engine from which the flywheel has been removed to show the breaker point assembly of the present invention.

Referring now to FIG. 1 there is illustrated generally an internal combustion engine 11 having an ignition system contact point assembly 13 fastened thereto by a mounting plate 15 and mounting bolts 17 and 18. The contact point assembly 13 is located closely adjacent a crank, cam or other rotatably shaft which moves in synchronism with engine operation. As illustrated, the ignition system contact point assembly is positioned close to crankshaft 19 which rotatably supports a cam or eccentric annulus 21. Crankshaft 19 also normally rotatably supports a flywheel beneath which the contact point assembly 13 is located with that flywheel having been omitted for clarity. The cam protuberance 25 actuates lever arm 23 to make and break electrical contact within the assembly 13. The cam or eccentric annulus 21 may be spaced from lever arm 23 during a portion only of each complete revolution of the annulus by a distance less than twice the eccentricity of the annulus so that the making and breaking of electrical contact occurs during each revolution of the annulus. The annulus 21 is formed of an electrically insulating and self-lubricating material so that it forms a continuous electrical barrier between the lever arm 23 and the crankshaft 19 and may, for example, be made from Celcon M-90-04 with a C-245 silicone concentrate as available from the Cellonese Company. Other cam materials may be employed, however, the use of an electrically insulating and self-lubricating material for the annulus is one of the important features of the present invention.

The contact point assembly 13 includes an electrically insulated housing 27 fastened as by rivets 29 and 31 to the mounting plate with this mounting plate being of a conductive material and electrically connected to the engine by the bolts 17 and 18. An externally accessible gap adjusting screw 33 threadingly engages the mounting plate 15 and is provided with a spring 35 to prevent screw 33 from moving due to engine vibration and the like. Thus, the gap adjusting screw 33 is electrically grounded to the engine 11. In addition to the insulating annulus 21, the breaker point assembly includes within the housing 27 an electrically conductive lever arm 23 which within the housing 27 carries a movable electric contact which engages and disengages a stationary but adjustable contact carried by the screw 33. This lever arm 23 pivots on a fulcrum within housing 27 and is spring loaded into engagement with the surface of cam 21 as will be better understood by referring to FIGS. 2 through 6.

Figure 2:
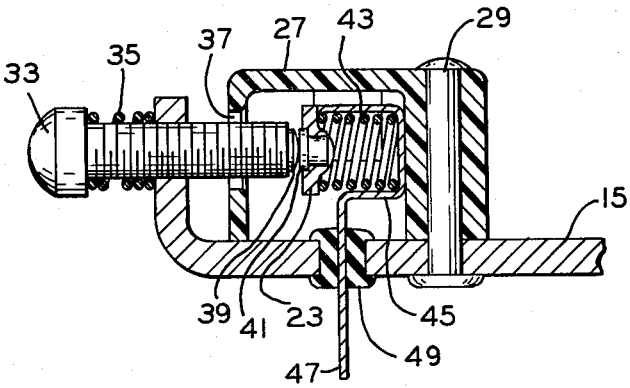
FIG. 2 is a cross-sectional view of the breaker point assembly along the line 2—2 of FIG. 1.

In FIG. 2 it will be seen that the mounting plate 15 serves to close the open end of housing 27 so as to protect the contact points from dirt, moisture, oil and the like when the mounting plate 15 and housing 27 are joined as by rivet 29. The externally accessible gap adjusting screw 33 threadingly engages the conductive mounting plate 15 and extends through an opening 37 into the housing 27. Screw 33 carries near the end thereof the stationary contacts 39. Lever arm 23 carries near the end opposite the portion of that arm visible in FIG. 1, a movable contact 41 with those two contacts engaging and disengaging as cam 21 rotates, actuating the lever arm 23. Contacts 39 and 41 are urged toward one another by a coil spring 43 and electrical connection to contact 41 includes that coil spring 43 as well as a U-shaped terminal 45 which extends from spring 43 through the mounting plate 15 to provide an external connection at 47 to a primary winding of an ignition coil. Terminal 45 is electrically insulated from the mounting plate 15 by a bushing or grommet 49 which is positioned in a hole in the base or mounting plate 15 through which the terminal leg 47 extends. Thus, when contact points 39 and 41 are touching, a complete circuit, including for example a storage battery and ignition system primary winding, is formed so that current flows in that primary winding, however, when points 39 and 41 separate that current is abruptly interrupted, inducing the desired high voltage surge in the ignition coil secondary winding.

Figure 4:
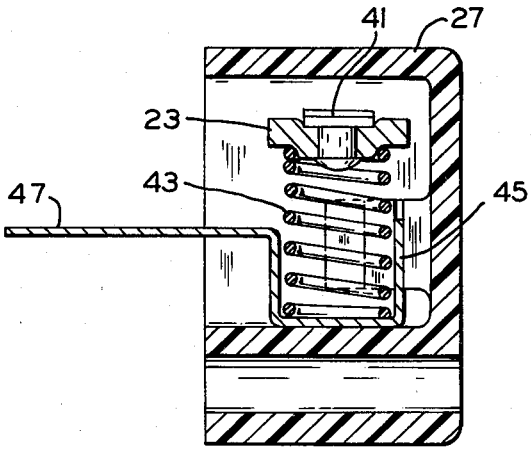
FIG. 4 is a view in cross-section along the lines 4—4 of FIG. 3.
Figure 6:
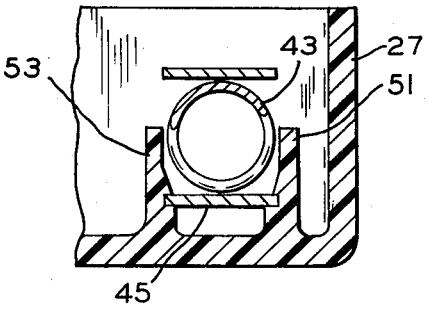
FIG. 6 is a cross-sectional view along the line 6—6 of FIG. 3.

The U-shaped terminal 45 is held in position within the insulating housing 27 by a pair of lugs 51 and 53 which, as best seen in FIGS. 4 and 6, are positioned generally parallel to one another for snapably receiving the terminal 45 to secure that terminal in position. The U-shaped portion of the terminal 45 receives coil spring 43 so that the terminal spring and lever arm are secured in the insulating housing 27.

Figure 3:
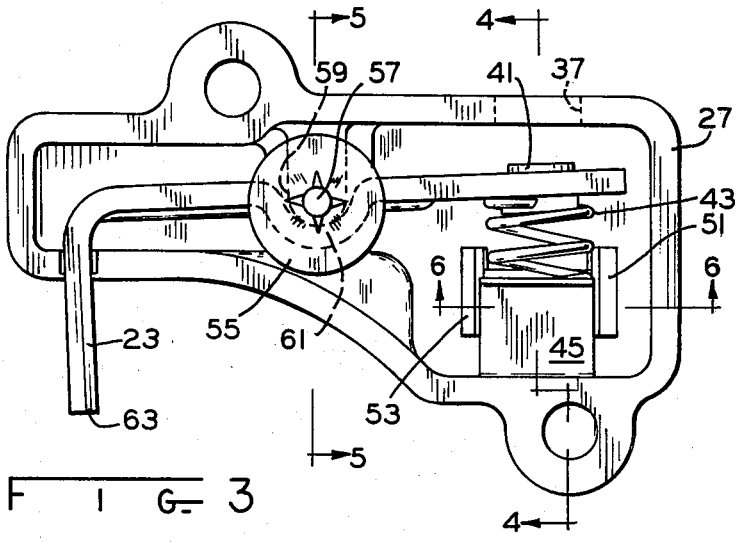
FIG. 3 is a side view of the breaker point assembly of FIGS. 1 and 2 from the direction opposite that of FIG. 1.
Figure 5:
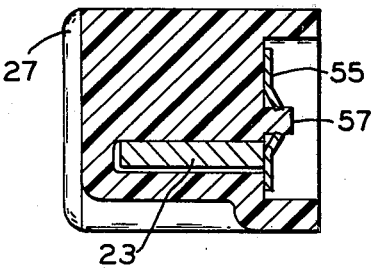
FIG. 5 is a view in cross-section along line 5—5 of FIG. 3.

Lateral movement of the lever arm 23 is prevented by a retainer 55 which engages a boss 57 of the insulating housing as depicted in FIGS. 3 and 5.

Referring primarily to FIG. 3, the operation of the breaker point assembly should now be easily understood. FIG. 3 is a view of the housing 27 from the side opposite that depicted in FIG. 1, with the mounting base 15 and adjustment screw 33 removed so that the remaining parts are easily seen. The housing 27 includes a protuberance 59 which functions as a fulcrum for the generally L-shaped steel lever arm 23. Arm 23 has a fulcrum receiving indentation intermediate the ends of one leg of the L so that the arm 23 may pivot about an axis determined by the protuberance 59 and indentation 61. Surface 63 of arm 23, of course, rides on the cam 21 during at least a portion of each revolution and contact 41 engages contact 39 only during a portion of each cam revolution.

When surface 63 of the lever arm 23 is not adjacent to the protuberance 25 on cam 21, contacts 41 and 39 are engaged with the spring 43 maintaining that engagement. When protuberance 25 rotates into position adjacent the surface 63, the arm 23 pivots in a clockwise direction, as depicted in FIG. 3, opening the contacts 39 and 41 and compressing spring 43. As the cam continues to rotate, surface 63 moves downwardly, as illustrated in FIG. 3, with the lever arm 23 pivoting in a counterclockwise direction about its axis so as to reengage the contacts 41 and 39 due to the urging of spring 43. Thus, spring 43 continuously urges the lever arm 23 in a counterclockwise direction, a depicted in FIG. 3 so that the lever arm contact 41 is urged toward stationary contact 39 and the lever arm end 63 is urged toward the cam surface, as well as being urged into engagement with the fulcrum 59.

When the base or mounting plate 15 is riveted to the insulating housing 27, contact surface 39 and 41 are enclosed in a relatively dirt, moisture and oil-free enclosure yet the stationary contact 39 is readily adjustable from outside that housing for point gap setting with the number of parts and assembly time being reduced by eliminating a separate cam follower and providing the electrical barrier between the movable contact arm and the engine in the form of the electrically insulating self-lubricating cam 21.

From the foregoing it is now apparent that a novel contact point assembly has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. In an internal combustion engine ignition system, an improved contact point assembly for following a rotating cam member and periodically interrupting ignition coil primary winding current flow inducing a high voltage ignition spark producing surge in a secondary ignition coil winding comprising:

an electrically insulating housing;

a fulcrum within the housing;

a lever arm within the housing having an electrical contact near one end thereof and with the other end extending beyond the housing to engage the cam member;

a threaded member passing into the housing and comprising an adjustable stationary contact; and a spring for urging the lever arm into engagement with the fulcrum, the lever arm contact toward the stationary contact, and the lever arm other end into engagement with the cam member.

2. The contact point assembly of claim 1 further comprising an electrical circuit including the spring for coupling the lever arm contact to an ignition coil primary winding.

3. The contact point assembly of claim 1 wherein the lever arm is formed of an electrically conductive material and the cam member is formed of an electrically insulating self-lubricating plastic material.

4. The contact point assembly of claim 1 further comprising a conductive mounting plate for closing the housing, threadingly engaging the threaded member and mounting the contact point assembly to an engine.

5. The contact point assembly of claim 1 wherein the lever arm is a generally L-shaped steel member having a fulcrum-receiving indentation intermediate the ends of one leg of the L, the other L-leg extending through the housing for engagement with the cam.

6. The contact point assembly of claim 1 wherein the fulcrum is formed as a side wall protuberance within the housing, the lever arm including a mating generally U-shaped indentation intermediate the ends thereof with the protuberance and indentation urged into pivotable engagement by the spring.

7. The contact point assembly of claim 6 wherein the lever arm is held captive laterally in the direction of its pivot axis on one side by the housing and on the other side by a boss engaging retainer.

8. The contact point assembly of claim 1 wherein the cam member is formed as an eccentric annular member of electrically insulating self-lubricating plastic material.

9. The contact point assembly of claim 8 wherein the cam member forms a continuous electrically insulating barrier between the fixed and the lever arm contacts.

10. The contact point assembly of claim 1 further including an electrical circuit for coupling the lever arm contact to an ignition coil primary winding comprising: the spring, and a U-shaped terminal for receiving the spring and having a leg adapted to extend beyond the assembly for connection to a conductor leading to a primary winding lead, the spring providing the connection between the terminal and the lever arm contact.

11. The contact point assembly of claim 10 wherein one primary winding lead is to be grounded and further comprising a metal base plate for closing the housing and mounting the contact point assembly to an engine, the primary winding circuit including mechanical engagement of the threaded member and the base plate.

12. The contact point assembly of claim 11 further including an insulating grommet positioned in a hole in the base plate through which the terminal leg extends.

13. The contact point assembly of claim 10 wherein the housing includes a pair of generally parallel lugs for snapably receiving the terminal and securing the terminal in position.

14. An ignition system breaker point assembly comprising:

an electrically insulating eccentric annulus for mounting on and rotation with a rotatable shaft;

an electrically conductive lever arm forming a movable electrical contact;

an electrically insulating fulcrum forming a pivot for the lever arm;

a spring for urging the lever arm in a pivotal manner about the fulcrum and into engagement with the annulus; and an adjustable stationary electrical contact located adjacent the lever arm and spaced therefrom during a portion only of each complete revolution of the annulus a distance less than twice the eccentricity of the annulus to make and break electrical contact between the lever arm and the stationary contact during each revolution of the annulus.

15. The breaker point assembly of claim 14 wherein the annulus forms a continuous electrically insulating barrier between the lever arm and the stationary contact.

16. The breaker point assembly of claim 14 wherein the annulus is formed of a self-lubricating material.

17. The breaker point assembly of claim 14 wherein the fulcrum comprises a portion of an electrically insulating housing through which a portion of the lever arm extends to periodically engage the annulus.

18. The breaker point assembly of claim 17 further comprising a conductive mounting plate for closing the housing to maintain the electrical contacting surfaces of the lever arm and stationary contact relatively free of dust, moisture, oil contamination and the like.

19. The breaker point assembly of claim 18 wherein the mounting plate threadingly supports the stationary contact and is adapted for mounting the breaker point assembly to an internal combustion engine.

20. The breaker point assembly of claim 19 wherein the lever arm is electrically connected to ignition circuitry exterior the housing by way of the spring.

21. An ignition system breaker point assembly for an internal combustion engine for mounting on the engine adjacent a rotatable engine shaft comprising:

an electrically insulating cam supported on the engine shaft for rotation therewith; and an electrically insulating housing containing a movable contact member and a stationary contact member with a portion of the movable contact member extending from the housing toward the cam to be actuated by the cam for engaging and disengaging the contacts.

22. The breaker point assembly of claim 21 wherein the stationary contact member is adjustable from outside the housing for varying the breaker point gap.

23. The breaker point assembly of claim 22 further comprising a conductive mounting plate for closing the housing to maintain the contacting surfaces of the movable and stationary members relatively free of contamination.

24. The breaker point assembly of claim 23 wherein the mounting plate threadingly supports the stationary contact and is adapted for mounting the breaker point assembly to an engine.

25. The breaker point assembly of claim 21 further comprising a spring disposed within the housing in continuous electrical and mechanical contact with the movable contact member for urging the movable contact member toward the stationary contact member.

* * * * *